US008780676B2

(12) United States Patent
Bonhoff

(10) Patent No.: US 8,780,676 B2
(45) Date of Patent: Jul. 15, 2014

(54) INTERACTIVE CLOCK WITH ANALOGUE TIME DISPLAY

(76) Inventor: Hannes Bonhoff, Berlin (DE)

( * ) Notice: Subject to any disclaimer, the term of this patent is extended or adjusted under 35 U.S.C. 154(b) by 0 days.

(21) Appl. No.: 13/696,636

(22) PCT Filed: May 10, 2011

(86) PCT No.: PCT/DE2011/075102

§ 371 (c)(1),
(2), (4) Date: Nov. 7, 2012

(87) PCT Pub. No.: WO2012/041302

PCT Pub. Date: Apr. 5, 2012

(65) Prior Publication Data

US 2013/0051195 A1 Feb. 28, 2013

(30) Foreign Application Priority Data

May 10, 2010 (DE) ..... 10 2010 020 466

(51) Int. Cl.
*G04B 19/00* (2006.01)

(52) U.S. Cl.
USPC ..... 368/225

(58) Field of Classification Search
USPC ..... 368/225, 224, 223, 69, 76, 77, 80, 228, 368/233, 234
See application file for complete search history.

(56) References Cited

U.S. PATENT DOCUMENTS

| | | | | |
|---|---|---|---|---|
| 5,359,578 | A * | 10/1994 | Truini | 368/76 |
| 7,061,833 | B2 * | 6/2006 | Dierenbach | 368/76 |
| 8,379,491 | B2 * | 2/2013 | Bonhoff | 368/80 |
| 2005/0017850 | A1 | 1/2005 | Nissila | |

FOREIGN PATENT DOCUMENTS

| | | | |
|---|---|---|---|
| EP | 0724204 | A1 | 7/1996 |
| WO | 2008019512 | A1 | 2/2008 |

OTHER PUBLICATIONS

International Search Report, PCT/DE2011/075102; Int'l File Date: May 10, 2011; Bonhoff, Hannes; 2 pages.

* cited by examiner

*Primary Examiner* — Edwin A. Leon
(74) *Attorney, Agent, or Firm* — Schmeiser, Olsen & Watts LLP

(57) ABSTRACT

An interactive watch with analogue time display, including an analogue time display with a display element, a movement configured to drive a rotation of the display element about a rotational axis, which rotation is movement-driven and associated with a time unit, and a read-off element manually rotatably mounted about the rotational axis such that a manual rotation of the read-off element leads to a thereby manually forced rotation of the display element or vice versa, wherein, for the display element, the manually forced rotation overlaps with the movement-driven rotation of the display element, so that in a manually set read-off position for the read-off element and the display element, these, when viewed together, result in the display of a current analogue value for the time unit due to the read-off element and the display element being arranged in associated rotational positions relative to the rotational axis is provided.

10 Claims, 10 Drawing Sheets

INTERACTIVE CLOCK WITH ANALOGUE TIME DISPLAY

The invention relates to an interactive watch with an analogue time display.

BACKGROUND

Precision engineering, in particular of fully mechanised movements, has a strong fascination for owners and interested parties and is therefore often the primary reason for buying a watch. Reading the time by observing the hands, however, does not permit any interaction with the mechanism of the movement. By being restricted to only one sense of perception when reading the time, i.e. visual perception, the mechanism of the movement is hardly accessible and fascination for it quickly vanishes.

SUMMARY

It is an object of the invention to provide an interactive watch with analogue time display which allows the user to operate it interactively when reading the time.

According to the invention this requirement is met by an interactive watch with an analogue time display according to independent claim 1. Advantageous embodiments of the invention are the subject of dependent sub-claims.

The invention comprises an interactive watch with analogue time display, comprising:

an analogue display with a display element, a movement or clock unit configured to drive a rotation of the display element about a rotational axis of the analogue display, which rotation is movement-driven and associated with or assigned to a time unit, and a read-off element manually rotatably about the rotational axis such that a manual rotation of the read-off element leads, thereby, to a manually forced rotation of the display element or vice versa, wherein, for the display element, the manually forced rotation overlaps with the movement-driven rotation of the display element, so that in a manually set read-off position for the read-off element and the display element these, when viewed or read together, result in the display a current analogue value for the time unit due to the read-off element and the display element being arranged in associated rotational positions relative to the rotational axis.

The watch, on the one hand, provides for a movement, with which a display element of a time unit is rotated about the axis of rotation of the analogue display. Reading the current time of the day with this watch is made possible only by providing an additional read-off element, which is also rotatably mounted about the rotational axis. In order to read the time it is necessary for the read-off element or the display element to be manually rotated by the user. When the read-off element is rotated manually, an additional rotation of the display element of the analogue display is forced manually, wherein vice versa, for a manual rotation of the display element, an additional rotation of the read-off element is forced. The manually forced rotation for the display element overlaps with the movement-driven rotation according to a superposition such, that in the time reading process initiated by the user by hand, a total rotation of the display element is performed which corresponds to the sum of two imprinted rotations. Manual operation of the read-off element therefore leads to both the rotation of the read-off element itself and to the forced rotation of the display element of the analogue display. The forced rotation does not interfere with the movement-driven rotation. Rather this continues undisturbed, irrespective of the manual rotation. Conversely, the user may perform a manual rotation of the display element in order to see the time, whereupon the read-off element performs a thereby forced manual rotation. For example, manual rotation of the display element may be effected by the movement being rotatably mounted, so that the user manually rotates the entire movement including the display element. For the display element the movement-driven rotation and the manually effected rotation superposition one another, either by the display element being rotated manually, or by the read-off element being rotated manually, which then forces manual rotation of the display element. In the various implementations, the movement-driven rotation and the manual rotation are decoupled from each other with respect to the display element, so that manual rotation does not imply any interference with the movement-driven rotation of the display element. Rather the two rotations overlap each other for the display element.

The current time can be read by the user, when the read-off element and the display element are arranged in associated rotational positions. The associated rotational positions correspond to a watch-specific relative positioning of the read-off element on the one hand and of the display element on the other, and which is characterised by a respective characteristic rotational position of the two elements. In this respect provision may be made for the analogue time value to be read when the read-off element and the display element are in the same rotational position relative to the rotational axis, i.e. in an identical angular position. But it is also possible to specify a fixed angular difference between the two rotational positions which then defines a specified read-off position of the two elements.

A movement specified in these terms generally represents a driving unit which supplies the driving force for the time-unit-associated rotation of the display element. The driving force may be mechanically coupled into the display element. Or provision may be made in another implementation for electrical signals to be provided for effecting the rotation.

To read the time the read-off element may be rotated clockwise or anti-clockwise. Further, reading the current time is preferably effected sequentially, for example reading the hour first and then the minute, when the analogue display comprises several display elements which are associated with different time units.

In a convenient implementation of the invention provision may be made for the read-off element and the display element to be arranged in identical rotational positions in the read-off position. If the display element and the read-off element are implemented as line elements, for example as pointer or hand elements, the same rotational position for the two elements means that the line elements are arranged so as to be radially aligned.

An advantageous embodiment of the invention provides for the movement to be configured so as to deliver a mechanical and/or electrical driving force for the movement-driven rotation of the display element about the axis of rotation. The pulse generator used for the movement could be a mechanical escapement or a quartz crystal. An electrical driving force could, for example, be provided by using one or more electric motors, for example in the form of stepping motors.

Preferably a further development of the invention provides for the analogue display to be formed of a mechanical display element and/or a display element generated on an optical display. A mechanical display element is formed, for example, with the aid of a pointer or hand arranged on a shaft driven by the movement. In conjunction with the implementation of the analogue display by means of an optical display the display is driven with the aid of control signals such that the optical display element rotates about a fulcrum or centre of rotation in the display plane. In an advantageous implementation of the invention provision may be made for the rotatably mounted read-off element to couple to the analogue display via a mechanical gear, such that when the read-off element is manually rotated the manually forced rotation of the display element is effected via the mechanical gear, or vice versa. The mechanical gear may, for example, be formed of a gearwheel drive. Different transmission ratios may be provided with the aid of the mechanical gear, in particular a transmission ratio of 2:1.

A further development of the invention may provide for the read-off element to couple to the movement, wherein when the read-off element is manually rotated the manually forced rotation of the display element is carried out in that the movement rotates due to the manual rotation of the read-off element, or vice versa. In the reverse case, the movement is manually rotated, and therefore the display element, whereby a manual rotation of the read-off element is forced. Provision may be made for the movement to be received, at least partially, in the housing which then rotates with manual operation. For example, in the case of a mechanical movement, parts thereof may be integrated with the housing.

A preferred further development of the invention provides for the display element to be formed as a pointer or hand.

In a convenient implementation of the invention provision may be made for the analogue display to comprise at least one further display element and for the movement to be configured to drive a rotation about an axis of rotation which is movement-driven and assigned to a further time unit of the further display element, wherein the further display element, when manually rotated together with the display element, carries out the manually forced rotation about the rotational axis. The time units represented by means of the display element and the further display element are, in particular, hours, minutes and/or seconds.

A further advantageous embodiment of the invention provides for the display element to be formed on a bezel or a watch glass.

One implementation of the invention may provide for a manual rotating mechanism providing the manual rotation of read-off element and display element to couple to a movement implemented as a mechanical movement, such that the manual rotation causes winding of the mechanical movement. The manual rotating mechanism, in this and other implementations, quite generally causes coupling between the rotation of the read-off element on the one hand and the manual rotation of the display element. The manual rotating mechanism may be formed by a mechanical coupling and/or an electronic control. Depending on whether manual rotation is effected manually by the user of the display element or the read-off element, the respectively other element, i.e. the read-off element or the display element is also forcibly rotated manually. For the display element this means that the movement-driven rotation and the manual rotation are superpositioned on each other. In the case of a mechanical movement provision may be made for the manual rotating mechanism to couple to this movement, wherein the manual rotation effected by the user additionally causes the mechanical movement to be wound up.

BRIEF DESCRIPTION OF DRAWINGS

The invention will now be described in detail by way of preferred embodiments with reference to figures in a drawing, in which.

DETAILED DESCRIPTION

Figure 1:
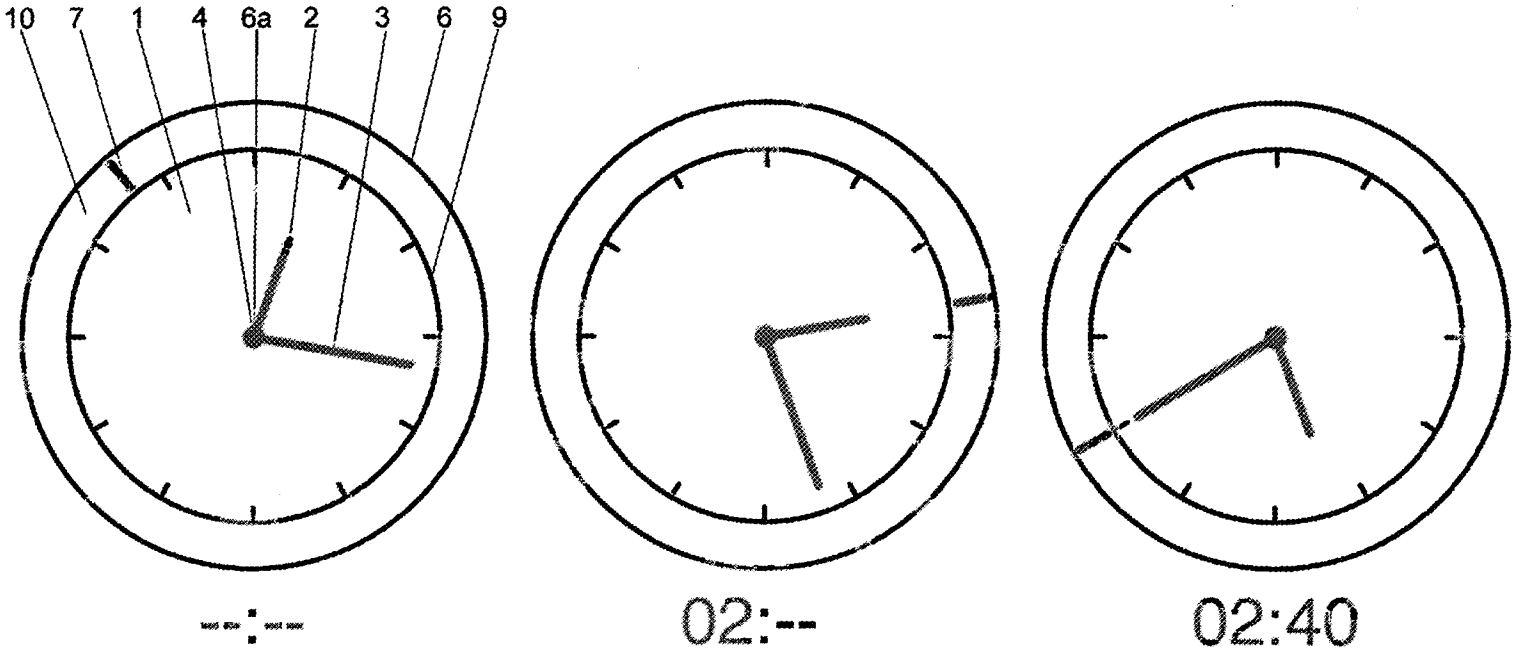
FIG. 1 shows a schematic illustration of a watch, in which the time is read by manually rotating a read-off element.

FIG. 1 is schematic illustration of a watch, in which, in order to read the time, a read-off element has to be rotated by hand. It is possible to read the time units in hour and minutes. To this effect an analogue display 1 comprises two display elements 2, 3 implemented as pointers or hands which are rotated about a rotational axis 4 corresponding to a cycle of a movement of the watch, wherein in the example shown the pointers (hands) 2, 3 are associated with the hour and minute cycle and thus could be also called hour hand and minute hand. The rotational axis 4. The rotational axis 4 extends vertically to the plane 6 of analogue display 1 through a fulcrum 6*a* on the analogue display 1, i.e. vertically to the image plane in FIG. 1. In addition a read-off element 7 is provided which is also rotatably mounted about rotational axis 4, wherein the read-off element 7 when rotated by hand by the user travels along the outer edge 9 of analogue display 1. In the variant shown the transmission ratio between the read-off element 7 and the hands 2, 3 is 2:1 when rotating the read-off element 7 by hand.

The embodiment of FIG. 1 shows the watch with a 12-hour and 60-minute dial. The read-off element 7 is shown as a line-shaped mark which is arranged radially on a bezel 10 of the watch.

In the first image (left) of FIG. 1 neither the minute nor the hour hand 2, 3 coincide with the read-off element 7. The current time is therefore not shown. The second image (centre) of FIG. 1 shows the watch after the read-off element 7 has been rotated manually such that it coincides with the hour hand 2 so that read-off element 7 and hour hand 2 are in identical rotational positions. For example, the read-off element 7 could have been rotated clockwise by about 120 degree. Please note that the two display elements 2, 3 rotate as a function of the read-off element 7. Since in the second image of FIG. 1 the hour hand 2 coincides with the read-off element, the current hour can be read, which is two. In the third image (right) in FIG. 1 the read-off element 7 was manually rotated such that it matches the minute hand or coincides with the minute hand 3 as regards the turning position or rotational position. For example it could have been rotated clockwise by almost 180 degrees. Now the current minute can be read which is 40. The current time resulting from the two reading operations is twenty minutes to three.

Figure 2A:
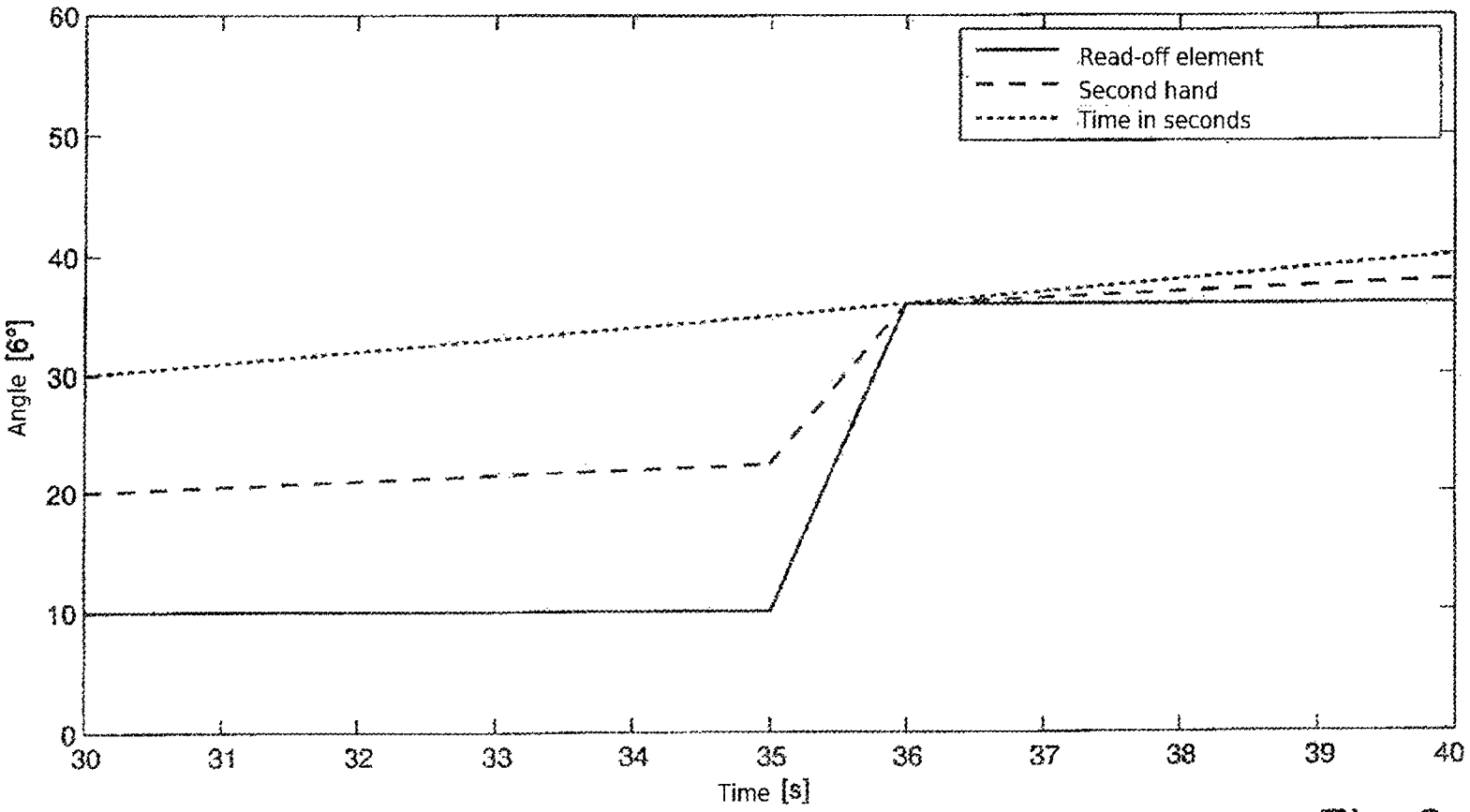
FIG. 2*a* shows a graphic illustration for time-dependent angular positions of a read-off element and a display element of an analogue time display, wherein the read-off element is rotated clockwise in order to read the time.
Figure 2B:
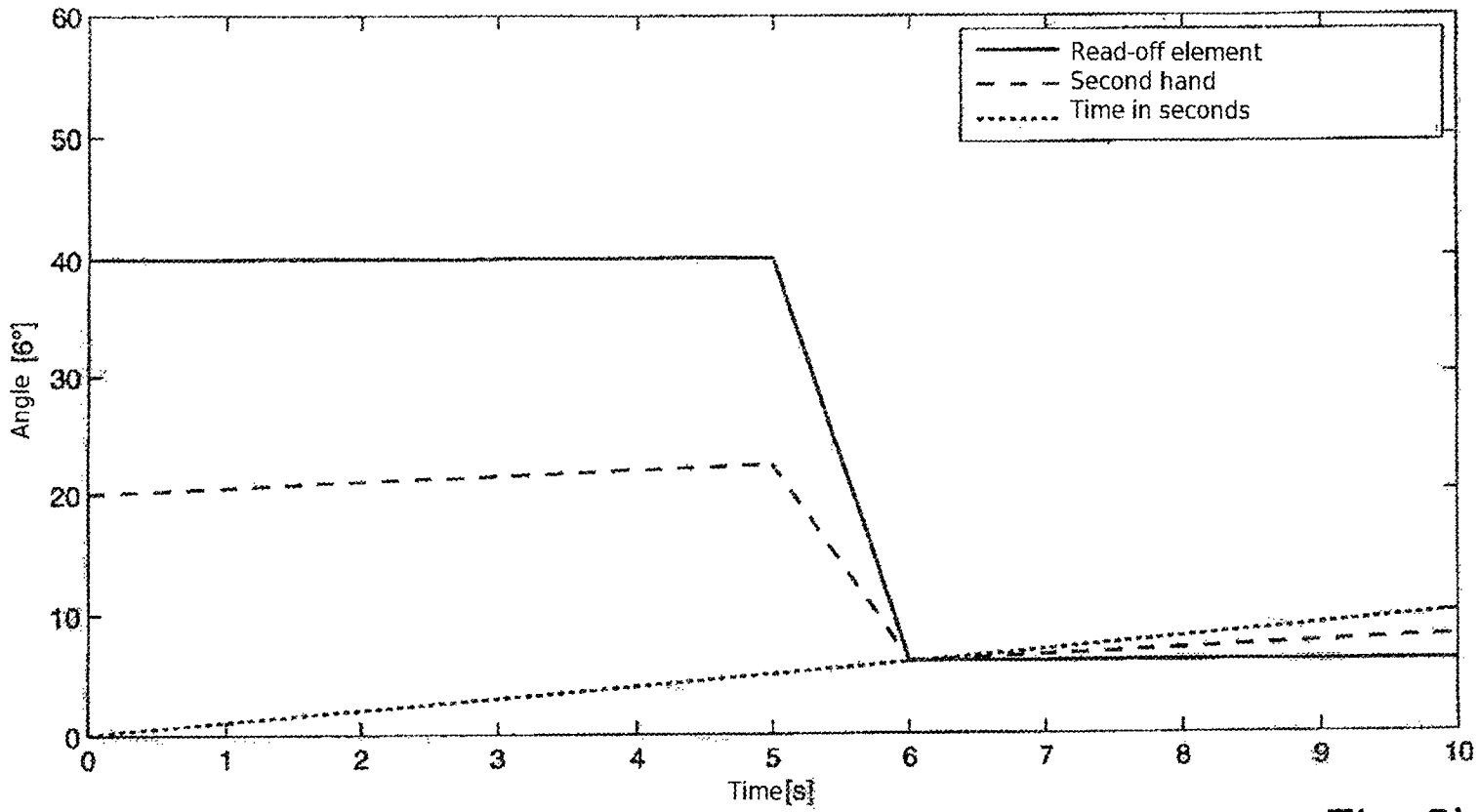
FIG. 2*b* shows a graphic illustration for time-dependent angular positions of a read-off element and a display element of an analogue time display, wherein the read-off element, contrary to FIG. 2*a*, is rotated anti-clockwise in order to read the time.

FIGS. 2*a* and 2*b* show transitory angular positions for a read-off element, a display element of the analogue display and the time as a function of time in two diagrams. With the embodiment shown the transmission ratio of the read-off element to the display element of the analogue display is 2:1. FIG. 2*a* shows an example, in which the display element is rotated clockwise for reading the time. FIG. 2*b* shows an example, in which the read-off element is rotated anti-clockwise.

The diagrams shown in FIGS. 2*a* and 2*b* show the interaction, in terms of time, of the read-off element 7 with a display element of the analogue display 1. The second has been chosen as the time unit to be displayed, therefore the display element 7 represents a second hand. The continuous line shows the angular position of the read-off element, the broken line the angular position of the second hand and the dotted line shows the angular position of the time in seconds. The dial has a 60-second scale, therefore an angle of 6 degrees corresponds to one second.

During the first five seconds in the diagrams of FIGS. 2*a* and 2*b* the read-off element 7 is not moved, therefore the angular position of the continuous line is constant. Between the fifth and sixth second the read-off element 7 is rotated manually such that it coincides with the second hand. At the point of time when the read-off element 7 coincides with the second hand, the common angular position corresponds to the time in seconds. This can be recognised by the fact that the three lines in FIGS. 2*a* and 2*b* coincide at the sixth second. At the sixth second therefore, the time and the display element move slowly on, wherein the read-off element 7 is again at a standstill. In FIG. 2*a* the read-off element 7 is rotated clockwise and in FIG. 2*b* is rotated anti-clockwise.

Using the diagrams shown in FIGS. 2*a* and 2*b* a possible rotational speed can be derived, in order to ensure that for a transmission ratio of read-off element 7 to display element of 2:1, the current time can be displayed by the read-off element 7 and the display elements 2, 3 coinciding with one another. Since the read-off element 7, while rotating, rotates twice as far as the display element, the angular distance of the display element to the current time must be half as great as that of the read-off element 7 to the current time. Graphically speaking this relationship can be recognised in FIGS. 2*a* and 2*b* by the fact that the display element must always be in the centre between the read-off element 7 and the time unit to be displayed. In order to ensure that this is true at any point in time the display element must thus rotate at half the rotational speed of the current time.

As an alternative to the graphic deduction of the transmission ratios between read-off element and display element for the variant shown in FIGS. 2*a* and 2*b*, the following formula may be used:

$$\alpha_Z=\alpha_A/2+\alpha_{Zk}/2 \quad (1)$$

In equation (1) $\alpha_Z$ is the angular position of the display element, $\alpha_A$ is the angular position of the read-off element and $\alpha_{Zk}$ is the angular position of the time unit to be displayed. For a dial of 12 hours, 60 minutes and 60 seconds the rotational speeds of hour, minute and second are:

$$\omega_H=-1/720 \text{ revolutions per minute}$$

$$\omega_{Mk}=-1/60 \text{ revolutions per minute}$$

$$\omega_{Sk}=-1 \text{ revolutions per minute}$$

Index H stands for hour, M for minute and S for second, wherein k indicates that these are the rotational speeds of the hands of conventional watches. Please note that a clockwise direction of rotation mathematically describes a negative sense of rotation.

For a stationary read-off element 7 the display element according to equation (1) moves at half of the rotational speed of the time unit to be displayed. For a dial of 12 hours, 60 minutes and 60 seconds, if the read-off element 7 is stationary, the following rotational speeds result for the hour, minute and second hands of the present variant of the watch:

$$\omega_H=-1/1440 \text{ revolutions per minute}$$

$$\omega_M=-1/120 \text{ revolutions per minute}$$

$$\omega_S=-1/2 \text{ revolutions per minute}$$

Since display elements 2, 3, because of the movement-driven rotation, rotate continuously slowly in addition to the rotation by the read-off element 7, the above-mentioned transmission ratios of read-off element 7 to display elements 2, 3 are not true for any given time. The transmission ratios given here therefore apply to the theoretical case, in which no time passes during manual rotation of the read-off element for reading the time.

When the read-off element 7 coincides with a display element, then for a transmission ratio of read-off element 7 to the display element of 2:1, the read-off element 7 can perform two revolutions until it again coincides with the display element. In this case the read-off element 7, after exactly one revolution, matches the angular position of the time unit to be displayed, whilst the display element points in the opposite direction, i.e. it has been turned by 180 degrees. One variant therefore provides for display elements which point in both directions (see FIG. 3). Such dual display elements point into directions which are offset by 180 degrees respectively. It should be pointed out that dual display elements match the display element 7 in only one angular position, not in two.

Figure 3:
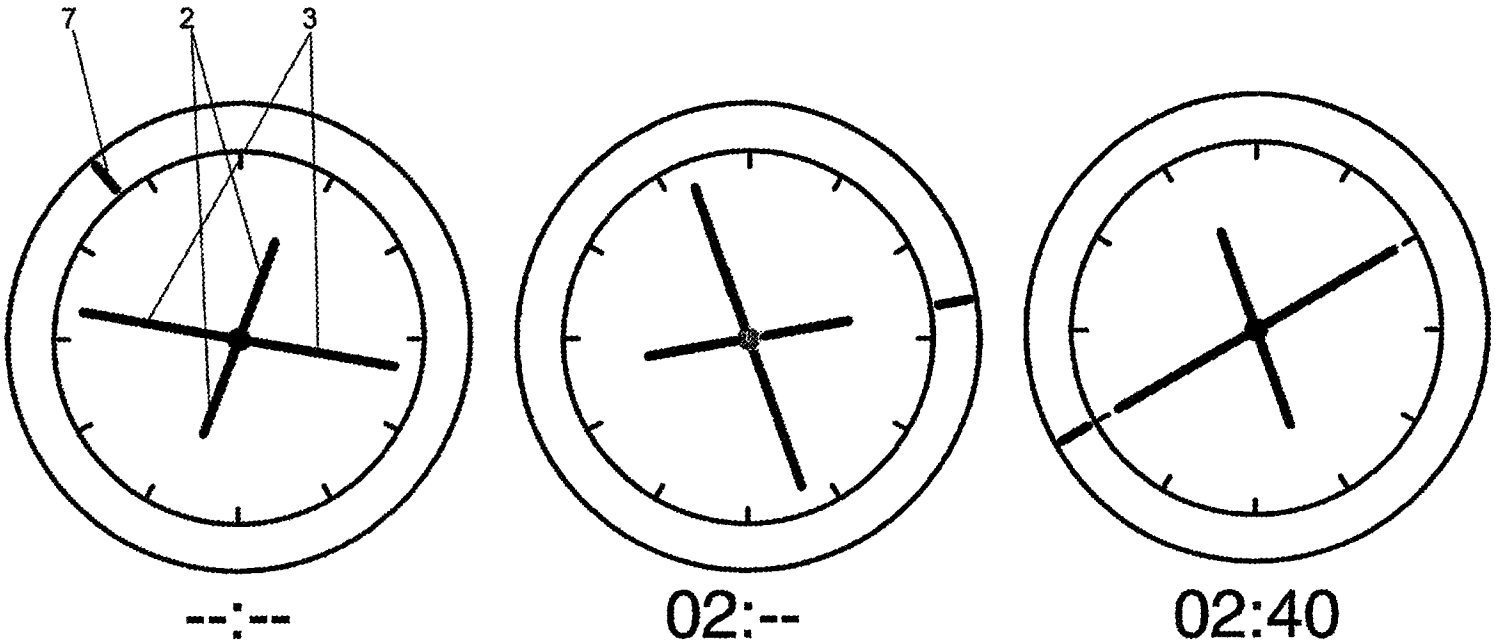
FIG. 3 shows a schematic illustration of a further watch, wherein a read-off element is to be rotated manually in order to read the time.

FIG. 3 shows a variation of the embodiment in FIG. 1 with the difference that dual display elements are used. In FIG. 3 the snapshots of the variant in FIG. 1 are shown with two-sided display elements 2, 3. The two shorter hands 2 together form the hour hand and the two longer hands 3 represent the minute hand. Starting with the image on the left in FIG. 3, in order to read the minute (see the image on the right in FIG. 3) the read-off element 7 in this embodiment only needs to be rotated anti-clockwise by barely 90 degrees, wherein in FIG. 1 a distinctly larger angle had to be traversed. Starting with the angular position, in which the read-off element 7 coincides with a display element 2, 3, in this variant the read-off element 7, after already one revolution matches the display element. The use of display elements which point in both directions, therefore permits reading the time through shorter paths of rotation.

Figure 4A:
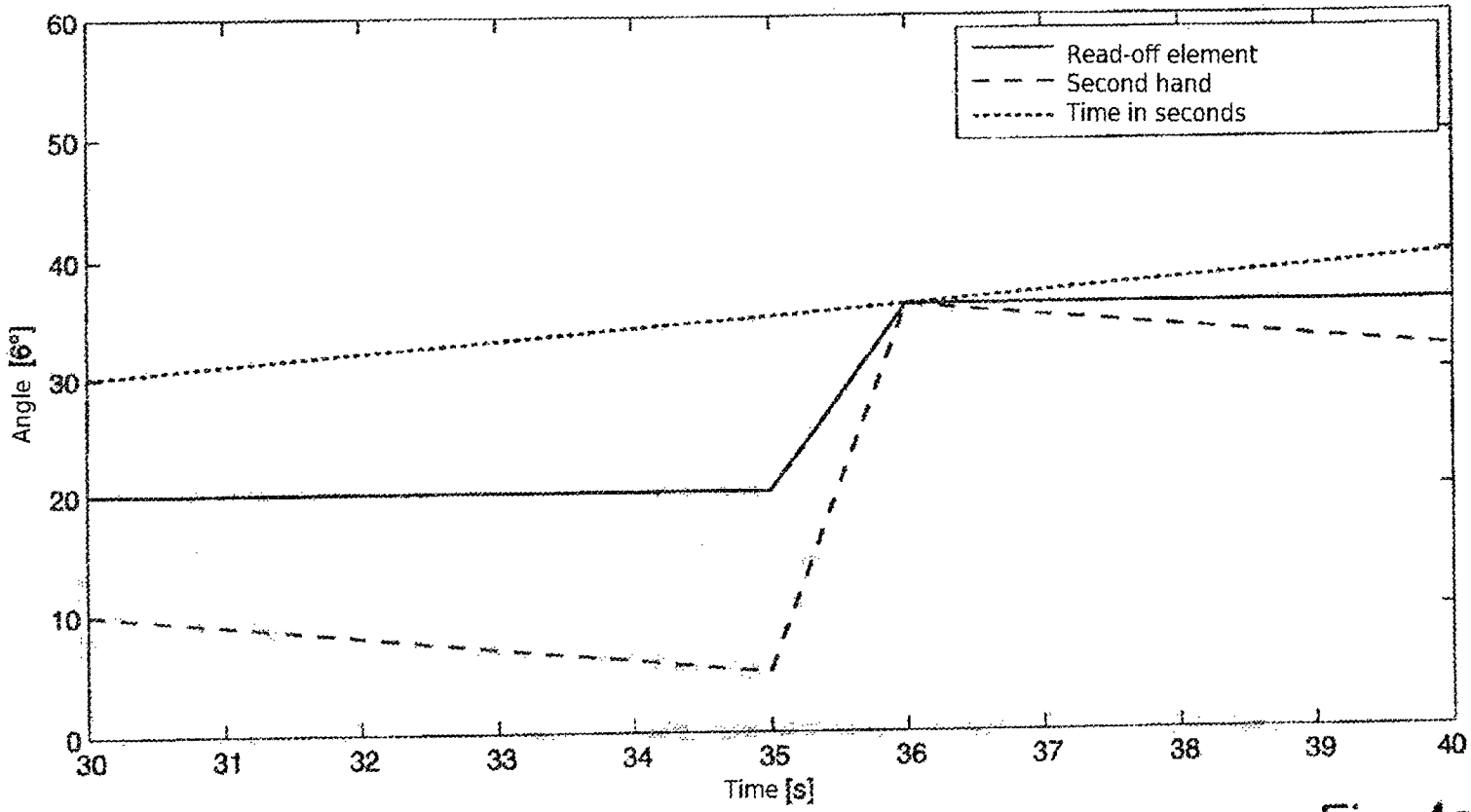
FIG. 4*a* shows a further graphic illustration for time-dependent angular positions of a read-off element and a display element of an analogue time display, wherein the read-off element is rotated clockwise in order to read the time.
Figure 4B:
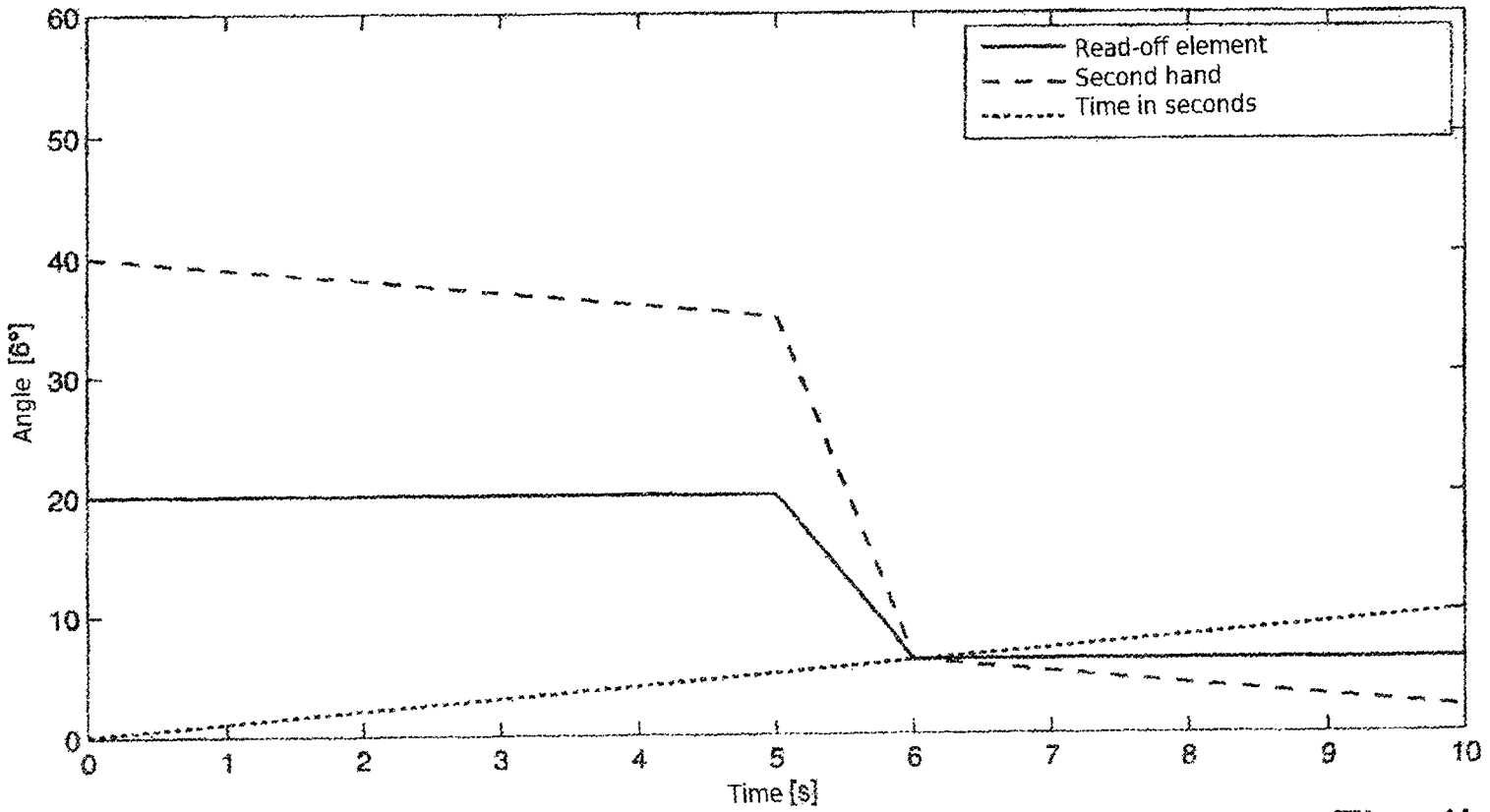
FIG. 4*b* shows a further graphic illustration for time-dependent angular positions of a read-off element and a display element of an analogue time display, wherein the read-off element, contrary to FIG. 4*a*, is rotated anti-clockwise in order to read the time.

FIGS. 4*a* and 4*b* show transitory angular positions for a read-off element, a display element of the analogue display and the time as a function of time in two diagrams. With the embodiment shown the transmission ratio of the read-off element to the display element of the analogue display is 1:2, i.e. the opposite to the ratio in FIGS. 2*a* and 2*b*. For one revolution of the read-off element 7, the display element completes two revolutions, respectively. The diagrams shown in FIGS. 4*a* and 4*b* are laid out in the same way as in FIGS. 2*a* and 2*b*. FIG. 4*a* shows an example, in which the read-off element is rotated clock-wise in order to read the time. FIG. 4*b* shows an example, in which the read-off element is rotated anti-clockwise.

For a transmission ratio of 1:2 the rotational speed of the display element can be derived from the diagrams in FIG. 4 in relation to the time to be displayed. Since in this case, as the read-off element is rotated, the display element rotates twice as fast, the angular distance from the display element to the current time must be twice as great as that of the read-off element to the current time. Graphically this can be recognised by the fact that the read-off element in FIG. 4 is in the centre between the angular positions of the display element and the time unit to be displayed. As a result the display element must rotate at the reverse rotational speed of the current time, in order to ensure that the angular position of the reading and display element match reflects the current time.

The ratio of the angular positions deduced by way of the diagrams in FIG. 4 can be summarised in the following formula:

$$\alpha_Z=2\alpha_A-\alpha_{Zk} \quad (2)$$

The rotational speeds of the hour, minute and second hands for a scale of 12 hours, 60 minutes and 60 seconds and for a transmission ratio of read-off element to display elements of 1:2 is thus for a stationary read-off element:

$\omega_H=1/720$ revolutions per minute $\omega_M=1/60$ revolutions per minute $\omega_S=1$ revolution per minute Starting from an angular position in which the read-off element 7 and one display element coincide, the display element, for a transmission ratio of read-off element to the display elements of 1:2, goes through two revolutions until it meets again with the read-off element. Analogously to the dual display elements for a transmission ratio of 2:1 therefore, a dual read-off element is provided in a variant with a transmission ratio of 1:2. A possible embodiment of a dual read-off element provides for two marks on the bezel. The two marks are offset from each other by 180 degrees, meaning that when one mark is at one o'clock the other one is at seven o'clock.

Based on equations (1) and (2) a general ratio between reading and display elements can be deducted:

$$\alpha_1=(n+1)\alpha_2/n-\alpha_{Zk}/n \quad (3)$$

In equation (3) $\alpha_1$ describes either the angular position of the read-off element and $\alpha_2$ the angular position of the display element or the other way round, $\alpha_1$ describes the angular position of the display element and $\alpha_2$ describes the angular position of the read-off element. The number n is an integer and positive and describes the number of revolutions, which the element requires with $\alpha_2$, in order to meet the element again with $\alpha_1$, starting from an angular position in which the two elements coincide. With the above-described variants n is therefore 1.

Equation (3) shows that the number n has an effect both on the transmission ratio of read-off element to display element and on the rotational speeds of the display elements. As an example, n in this case may be equal to two, wherein $\alpha_1$ describes the angular position of the read-off element and $\alpha_2$ describes the angular position of the display element. Equation (3) can thus be reformulated as follows:

$$\alpha_Z=2\alpha_A/3+\alpha_{Zk}/3 \quad (4)$$

Figure 5:
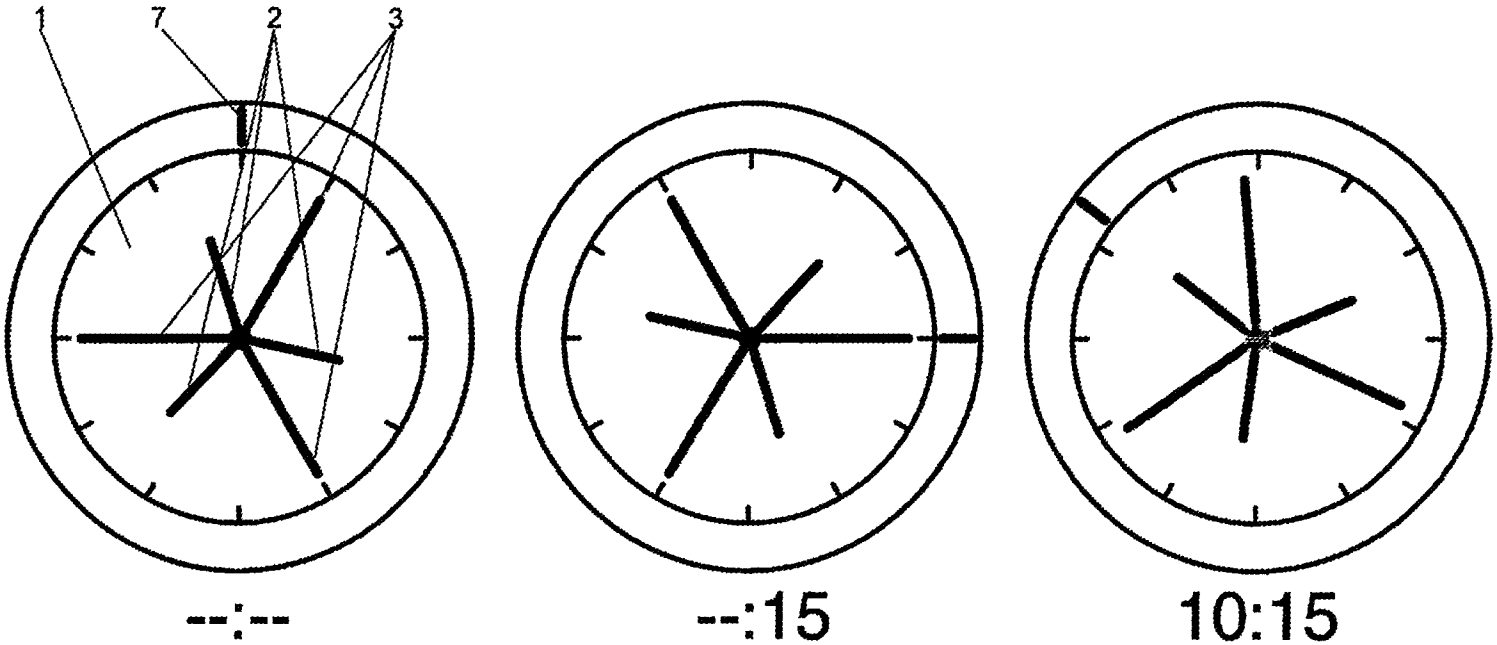
FIG. 5 shows a schematic illustration of a watch with several display elements, wherein a read-off element is to be manually rotated in order to read the time.

Equation (4) shows that the transmission ratio of read-off element to display element is 3:2 in this variant and that the display elements for a stationary read-off element rotate at a third of the speed of the time unit to be displayed. For a 12 hour, 60 minute and 60 second scale the display elements thus comprise the following rotational speeds for a stationary read-off element:

$\omega_H=-1/2160$ revolutions per minute $\omega_M=-1/180$ revolutions per minute $\omega_S=-1/3$ revolutions per minute In the same way as dual display elements can be used with the embodiment with a transmission ratio of read-off element to display element of 2:1, see equation (1) and FIG. 3, so for a transmission ratio of 3:2 threefold display elements can be used. As shown in FIG. 5 the three hands of the respective display element point away from each other by 120 degrees. The three shorter hands together form the hour hand and the three longer hands represent the minute hand. By using display elements which point into several directions, the necessary angles required to be passed through for reading the time, may be narrowed.

FIG. 5 shows schematic diagram of a watch with display elements with several hands on the analogue display 1, wherein for reading the time the read-off element 7 has to be manually rotated. The transmission ratio of the manual turning of read-off element 7 to the thus forced rotation of the display elements of analogue display 1 is here 3:2. In the left-hand image of FIG. 5 the watch is shown prior to the reading process, followed by the central image in FIG. 5 for reading the minute. In the right-hand image in FIG. 5 the hour can be read.

It is emphasised that the angle relationships in equations (1) to (4) describe the preferred transmission ratios between read-off elements and display elements, and merely represent variants of the embodiment. The same is true of the scales used up to now, since in further variants for example, 24 hour scales or graduated circle scales are provided. Illustrations of other transmission ratios and scales are found in the embodiment shown in FIG. 6.

Figure 6:
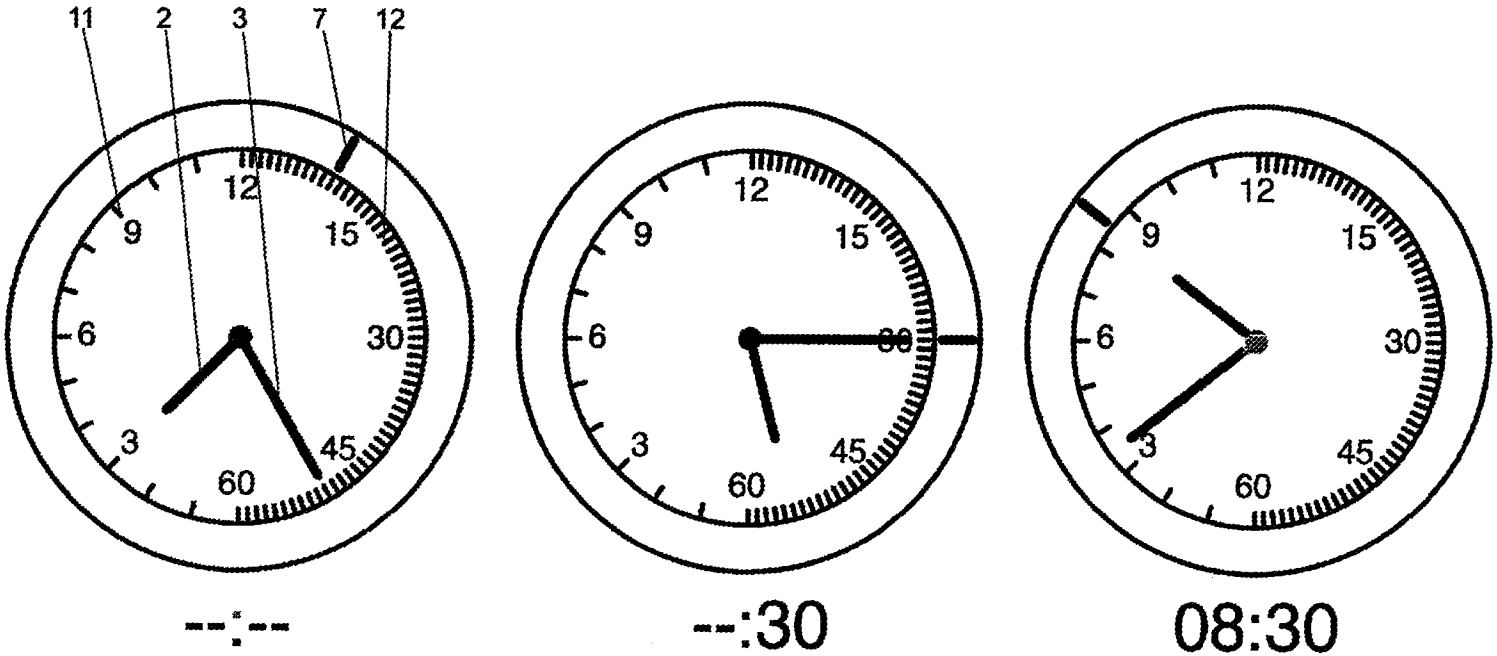
FIG. 6 shows a schematic illustration of a watch with several display elements, wherein a read-off element is to be manually rotated in order to read the time and wherein numbers and graduations for different time units are shown.

FIG. 6 shows an embodiment of a watch in the following sequence: prior to reading the time (left), for reading the minute (centre) and for reading the hour (right). With the scale used in FIG. 6, the dial is divided vertically into two halves. The semi-circle scales 11, 12 thus created give the hour from 0 to 12 on the left and the minute from 0 to 60 on the right. Both scales run clockwise. The transmission ratio between read-off element 7 and display elements 2, 3 is 1:1 with opposite direction of rotation. For a rotation of the read-off element 7 about a defined angle the display elements 2, 3 therefore rotate about the same angle, but in the opposite direction. With the present transmission ratio of 1:1 the display elements 2, 3, for a stationary read-off element 7, must rotate for rotational speeds of conventional hands on a 12-hour and 60-minute full circle scale.

Figure 7:
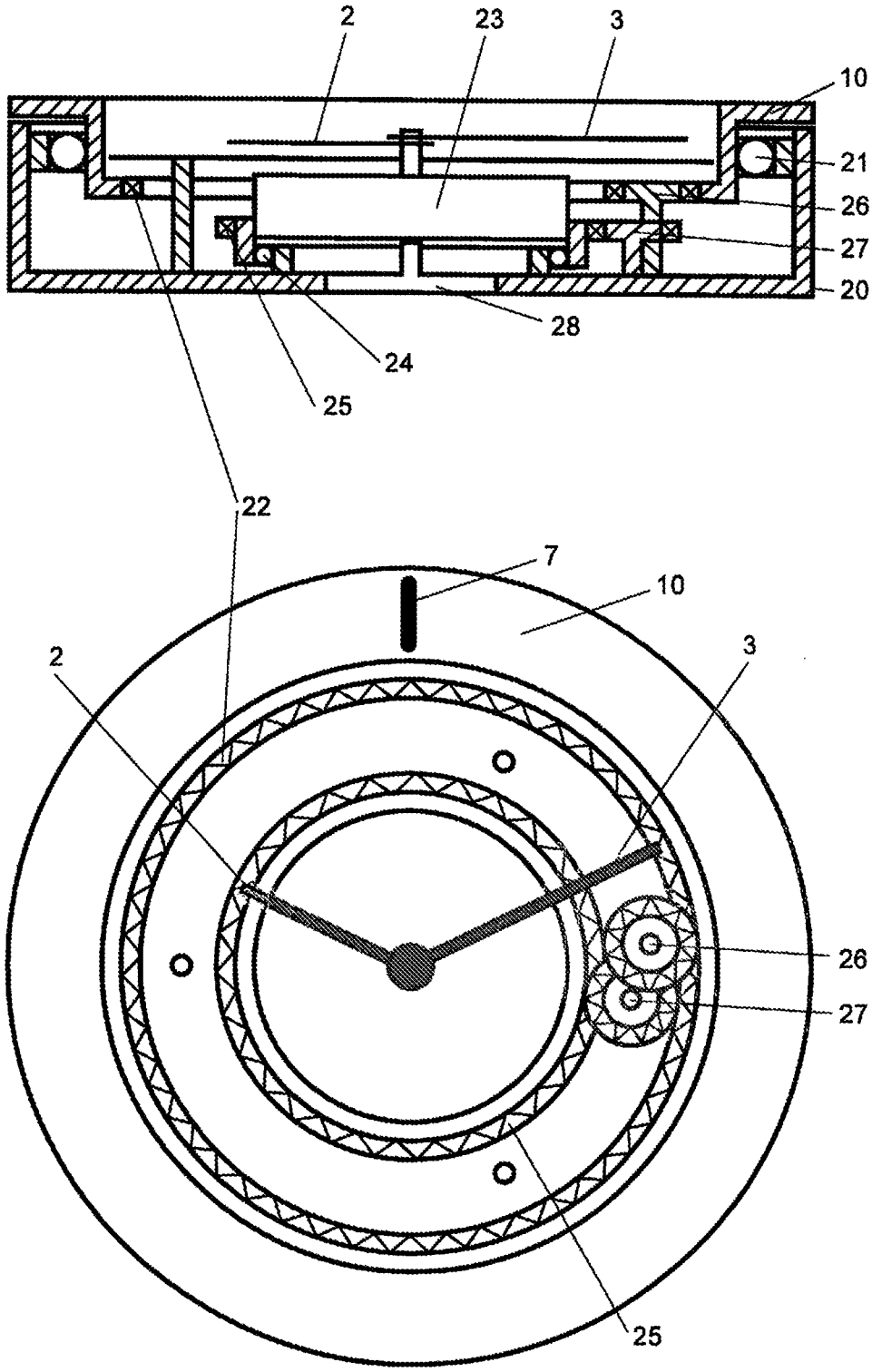
FIG. 7 shows a schematic illustration for constructing a watch, in which a read-off element is to be manually rotated in order to read the time.

FIG. 7 shows a schematic diagram for the construction of a watch on which, in order to read the time, a read-off element must be turned by hand. FIG. 7 shows an example of a possible construction of the watch, with which the rotational speeds and transmission ratios developed with reference to FIGS. 2 and 4 can be realised. The picture at the top in FIG. 7 shows a simplified sectional representation of a watch housing 20. The picture at the bottom in FIG. 7 shows a top view of the watch, wherein the dial is not shown.

In FIG. 7 the dial is fixedly connected at three points with the watch housing 20. The read-off element 7 is designed as a line-shaped mark on the bezel 10 and thus is rotatable by hand directly without transmission. Bezel 10 is rotatably mounted by means of ball bearing 21 and comprises an internal tooth gear 22. A movement 23 is also rotatably mounted by means of a ball bearing 24, but comprises an external tooth gear 25. Bezel 10 and movement 23 are mechanically coupled to each other by two gears 26, 27 and therefore rotate in the same direction. Due to the two gears 26, 27 a transmission ratio from the bezel 10 to the movement 23 is set to 2:1 (see equation (1) and FIG. 2 above). For one full anti-clockwise revolution of bezel 10 therefore the movement 23 rotates anti-clockwise by half a revolution. The movement 23 drives an hour-hand 2 and a minute-hand 3, wherein the hands rotate at half the speed of a conventional hour- and minute-hand. In order to obtain the rotational speeds and transmission ratios of equation (2) or FIG. 4, the two gears 26, 27 must be laid out differently and the movement 23 must drive the display elements 2, 3 at the opposite rotational speed of the time unit to be displayed.

In order to realise the required rotational speeds of display elements 2, 3 using a mechanical movement 23, further gears are provided in a further variant in the mechanical movement for the necessary reduction or reversal of the direction of rotation. For reversing the direction of rotation a mirror-inverted anchor and anchor wheel with an inversely wound spiral spring represent a further possibility for realisation. If existing movements shall be used, a gear train may be connected to the pointer shafts as an alternative thereby avoiding interfering with the mechanics.

When using a quartz movement, according to one variant the rotational speeds of the display elements can be halved in that a further divider is installed in the electronics. Alternatively a quartz oscillator may be used which oscillates at a correspondingly slower frequency. With these two embodiments the required rotational speeds of the display elements can be obtained without interfering with the mechanics of the movements.

In the construction of FIG. 7 the time is set, for example, by adjusting the hour and minute hands in the rotatably mounted movement 23. To this end a time-setting button 28 is provided on the back of the watch housing 20. When the button is pressed it engages on the axis of rotation in the gear train of the rotatably mounted movement 23, similarly to pulling out the crown on a conventional watch for setting the time. The time can then be adjusted by rotating the movement 23 about the stationary time-setting button 28 by means of bezel 10. For an intuitive operation it might be preferred to choose the transmission ratios of the time-setting mechanism such that a full revolution of bezel 10 would adjust the time by exactly one hour.

Quartz movements offer a further possibility for setting the time. If the hands are set electronically the time-setting button 28 in FIG. 7 can operate them directly or indirectly via magnets. In one variant provision is made to have the current time set automatically by radio or GPS via an electronic control.

With a rotatably mounted movement it may be problematic to change the batteries required for the electronics from below. In one embodiment of the watch according to the invention the batteries are therefore attached laterally in the movement. In this variant the movement may be mounted on the floor of the housing so that the batteries are accessible when the housing floor is unscrewed.

With mechanical movements which are wound manually or automatically by a rotor, one variant provides for using the rotation of the movement 23 for reading the time also for winding up the movement 23. With a winding-up mechanism similar to that of automatic movements, the rotating energy can be utilised in both directions. In a technical realisation of the winding mechanism provision is made to connect the rotor of the movement with the stationary housing 20 of the watch according to the invention in such a way that the rotor is stationary in relation to the watch housing 20. In consequence the rotor then does not rotate about the movement as in conventional automatic watches for winding up the movement, but the movement rotates about the rotor for reading the time.

A further possible variant relates to the drive of the read-off element 7 (see example FIG. 1). The drive can be fastened below the watch glass in such a way that it cannot be touched directly. Rotation of the read-off element 7 by hand may in this case take place indirectly via a gear train. One possibility would, for example, be a construction similar to the crown on conventional watches with a mechanical display. By means of rotating on such a crown, the read-off element 7 can then be rotated in the same way in which for example, the minute and hour hands on conventional watches with a mechanical display can be adjusted for adjusting the time. Alternatively the manually forced relative movement between read-off element 7 and display element 2, 3 may be effected in that the display elements 2, 3 are rotated manually by the user in addition to the movement-driven rotation, for example in that the movement 23 (see FIG. 7) is manually rotated. The manual rotation of the display elements 2, 3 effected in this way overlaps with the movement-driven rotation. At the same time manual rotation of the read-off element 7 is forced so that in the end the reading position for display elements 2, 3 and read-off element is set by hand.

Since the viewing- or reading-together of display and read-off element can be accomplished by wholly or partially overlapping or framing and matching the sides or ends of the hands, these can be designed in any desired geometric shape or as recesses. Further several read-off elements can be used, for example one read-off element for each display element. An illustration of the possible shapes of display elements and read-off elements as well as of the use of several read-off elements for the watch according to the invention can be found in FIG. 8.

Figure 8:
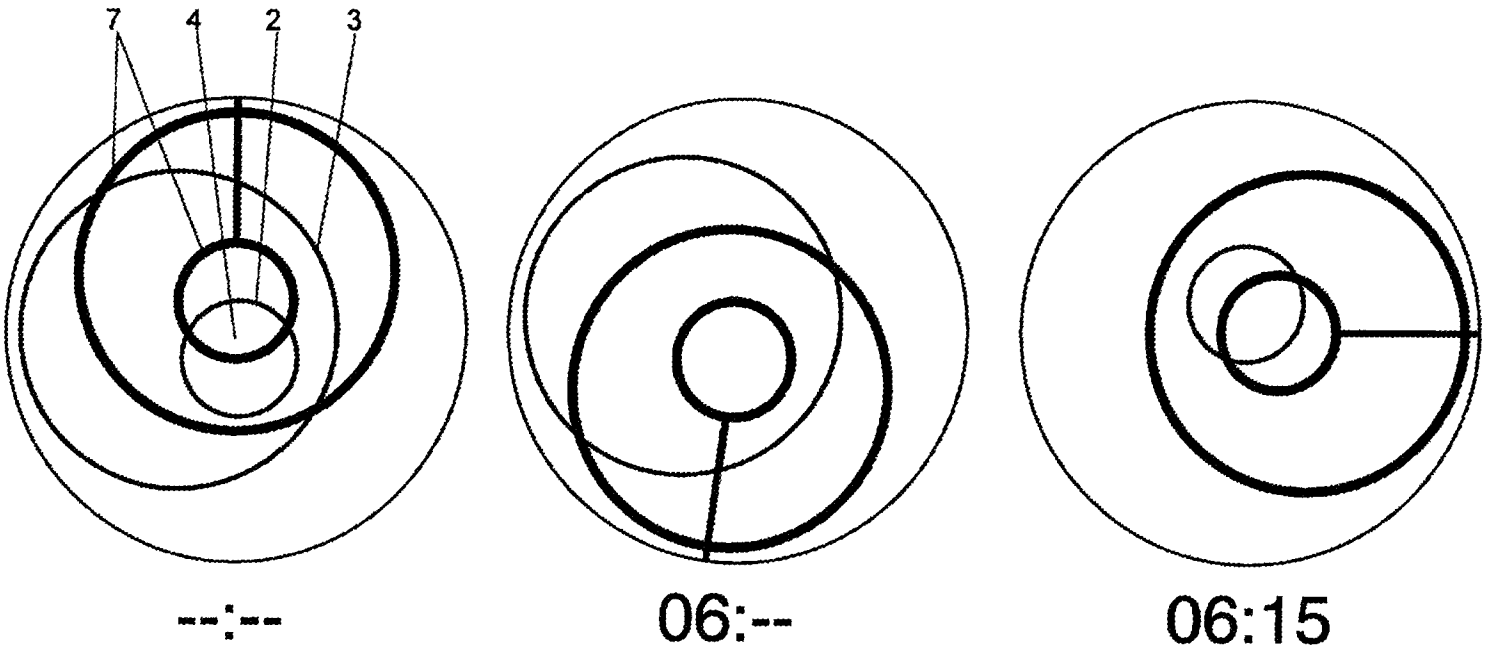
FIG. 8 shows a schematic illustration of a watch with several circular display elements and read-off elements, in which the read-off elements are to be manually rotated in order to read the time.

FIG. 8 shows a variation of the embodiment of FIG. 3, but with the difference that circular display elements 2, 3 and two read-off elements 7 are used. The display element 2 for the hour is shaped as a small circle and the display element 3 for the minute is shaped as a large circle. The current hour is read with the aid of a further small circle which serves as read-off element 7 and the current minute is read with the aid of a correspondingly large circle. It should be noted that both the read-off elements and the display elements comprise the same rotational axis 4. Since the angular position of eccentric circles and circular scales is difficult to read accurately, the read-off elements additionally comprise radially arranged line marks. The current time can be read in that the read-off elements 7 are manually rotated such that the corresponding circles match.

The features of the invention disclosed in the above description, the claims and the figures can be of importance both individually and in any given combination for the implementation of the invention in its various implementations.

The invention claimed is:

1. An interactive watch with analogue time display, comprising:

an analogue display with a display element;

a movement configured to drive a rotation of the display element about a rotational axis of the analogue display, wherein the rotation is movement-driven and associated with a time unit; and a read-off element manually rotatably mounted about the rotational axis such that a manual rotation of the read-off element leads to a manually forced rotation of the display element or vice versa, wherein, for the display element, the manually forced rotation overlaps with the movement-driven rotation of the display element, so that exclusively in a manually set read-off position for the read-off element and the display element these, when viewed together, result in a display of a current analogue value for a time unit due to the read-off element and the display element being arranged in associated rotational positions relative to the rotational axis.

2. An interactive watch according to claim 1, wherein in the read-off position the read-off element and the display element are arranged in identical rotational positions.

3. An interactive watch according to claim 1, wherein the movement is configured to deliver a mechanical and/or electrical driving force for the movement-driven rotation of the display element about the rotational axis.

4. An interactive watch according claim 1, wherein the analogue display is formed by a mechanical display element and/or a display element generated on an optical display.

5. An interactive watch according to claim 1, wherein the rotatably mounted read-off element couples to the analogue display via a mechanical gear such that when the read-off element is manually rotated, the manually forced rotation of the display element is effected via the mechanical gear, or vice versa.

6. An interactive watch according to claim 1, wherein the display element couples to the movement, wherein during manual rotation of the display element the manually forced rotation of the display element is carried out in that the movement rotates due to the manually forced rotation of the display element or vice versa.

7. An interactive watch according to claim 1, wherein the display element is formed as a pointer or hand.

8. An interactive watch according claim 1, wherein the analogue display comprises at least one further display element and the movement is configured to drive a rotation of a further display element about the rotational axis, which rotation is movement-driven and associated with a further time unit, wherein the further display element during manual rotation, carries out the manually forced rotation about the rotational axis together with the display element.

9. An interactive watch according to claim 1, wherein the display element is formed on a bezel or a watch glass.

10. An interactive watch according to claim 1, wherein a manual rotation mechanism responsible for the manual rotation of read-off element and display element couples to a movement implemented as a mechanical movement such that the manual rotation causes a winding-up of the mechanical movement.

* * * * *